United States Patent [19]

Takahashi

[11] 4,392,517

[45] Jul. 12, 1983

[54] WEFT PICKING METHOD AND DEVICE FOR CARRYING OUT SAME

[75] Inventor: Takao Takahashi, Hachioji, Japan

[73] Assignee: Nissan Motor Co., Ltd., Yokohama, Japan

[21] Appl. No.: 218,325

[22] Filed: Dec. 19, 1980

[30] Foreign Application Priority Data

Dec. 26, 1979 [JP] Japan ..... 54-168171

[51] Int. Cl.[3] ..... D03D 47/30

[52] U.S. Cl. ..... 139/435

[58] Field of Search ..... 139/435; 226/97

[56] References Cited

U.S. PATENT DOCUMENTS

| | | | |
|---|---|---|---|
| 3,705,608 | 12/1972 | Vermeulen | 139/435 |
| 3,818,952 | 6/1974 | Vermeulen et al. | 139/435 |
| 4,143,681 | 3/1979 | Kuda et al. | 139/435 |
| 4,319,611 | 3/1982 | Foltyn et al. | 139/435 |
| 4,321,947 | 3/1982 | Cech et al. | 139/435 |

FOREIGN PATENT DOCUMENTS

| | | | |
|---|---|---|---|
| 108582 | 4/1963 | Czechoslovakia | 139/435 |
| 165002 | 2/1975 | Czechoslovakia | 139/435 |
| 166347 | 6/1975 | Czechoslovakia | 139/435 |
| 179657 | 3/1977 | Czechoslovakia | 139/435 |
| 181148 | 5/1977 | Czechoslovakia | 139/435 |
| 1098456 | 1/1961 | Fed. Rep. of Germany | 139/435 |
| 2051455 | 5/1971 | Fed. Rep. of Germany . | |
| 2639998 | 6/1978 | Fed. Rep. of Germany . | |
| 2743701 | 6/1978 | Fed. Rep. of Germany . | |
| 2328135 | 8/1978 | Fed. Rep. of Germany | 139/435 |
| 54-106663 | 8/1979 | Japan | 139/435 |
| 54-106664 | 8/1979 | Japan | 139/435 |
| 1461915 | 1/1977 | United Kingdom | 139/435 |
| 2003514 | 3/1979 | United Kingdom | 139/435 |

*Primary Examiner*—Henry Jaudon

*Attorney, Agent, or Firm*—Thompson, Birch, Gauthier & Samuels

[57] ABSTRACT

In an air jet loom of the type wherein a weft yarn projected from a weft inserting nozzle is carried through a weft guide channel to pick the weft yarn into a shed of warp yarns by air jets from a plurality of auxiliary nozzles, weft picking is carried out by controlling the ejection of air jets from the auxiliary nozzles in a manner to simultaneously commence the air jet ejections from all the auxiliary nozzles prior to the time the weft yarn from the weft inserting nozzle reaches the auxiliary nozzle closest to the weft inserting nozzle, thereby producing a steady state air steam within the weft guide channel to stably complete a weft insertion into the shed of warp yarns.

12 Claims, 3 Drawing Figures

WEFT PICKING METHOD AND DEVICE FOR CARRYING OUT SAME

BACKGROUND OF THE INVENTION

This invention relates to a weft picking method and a device for carrying out the method in an air jet loom of the type wherein a weft yarn is carried by air jets from auxiliary nozzles in addition to an air jet from a weft inserting nozzle or main nozzle, and more particularly to an improvement in a method for ejecting air from the auxiliary nozzles to a weft guide channel defined by the almost closed circular sections of a plurality of air guide members.

Many methods for accomplishing weft picking by ejecting air from a plurality of auxiliary nozzles in addition to a weft inserting nozzle have been proposed in which there is a method wherein the weft picking is accomplished by carrying a weft yarn through a weft guide channel formed by a plurality of air guide members. Each air guide chamber is formed with a generally circular section which is almost closed except for a narrow slit, which circular section defines at its inner surface the above-mentioned weft guide channel, and therefore, such an air guide member is referred to as "a closed type air guide member".

The weft picking methods using the closed type air guide members can be classified into two categories. One of them is as follows: the inner surface of the circular section of the air guide member is tapered in the direction of the loom side which is opposite the weft inserting nozzle. With such air guide members, an air jet from the weft inserting nozzle is, after serving to pull the weft yarn to be picked out of the weft inserting nozzle, ejected into the weft guide channel formed by the circular section tapered inner surfaces of successively positioned air guide members, in order to form an air stream which gradually converges toward the aforesaid opposite loom side. In addition to this, auxiliary air jets are ejected from the auxiliary nozzles to assist the main air stream.

The other of the two method categories is as follows: the inner surface of the circular section of the air guide member is not tapered, in which an air jet from the weft inserting nozzle is, after serving to pull the weft yarn out the weft inserting nozzle, guided through the weft guide channel so that the guided air is dispersed through each alignment clearance formed between the adjacent air guide members. Thereafter, a portion of an air jet from an auxiliary nozzle is ejected through the alignment clearance of the row of air guide members into the weft guide channel to push the weft yarn against a side of the weft guide channel and then strike the inner surfaces of the circular sections of the air guide members to be deflected so as to guide the weft yarn to the vicinity of the succeeding auxiliary nozzle. Then, the succeeding auxiliary nozzle ejects an air jet to take over the weft yarn carrying action of the preceding auxiliary nozzle. Such weft yarn carrying action is taken over, in turn, by the further succeeding auxiliary nozzles to carry the weft yarn through the weft guide channel.

However, the above mentioned methods have encountered drawbacks in which the interference of the air jet from the weft inserting nozzle with the air jets from the auxiliary nozzles occurs at a transitional stage where the air ejection from the auxiliary nozzle starts, so that the air stream formed in the weft guide channel is unavoidably disturbed.

Specifically, in the above-mentioned former method wherein the main air stream through the weft guide channel is formed mainly by virtue of the air jet from the weft inserting nozzle, the head section of the air stream goes ahead of the leading end of the weft yarn to be picked and, therefore when an air jet from the first auxiliary nozzle (closest to the weft inserting nozzle) is angularly ejected from behind the air stream head section toward the head section of the air stream, the air stream head section is divided into two sections bounded by a location to which the air jet from the auxiliary nozzle strikes. The rear part of the air stream head section is pushed angularly forward and is thus accelerated, but the front section is slightly pulled backward and is thus decelerated. Accordingly, at the next step, both the front and rear sections of the divided air stream head section strike each other to generate a turbulence in the weft guide channel.

Also in the above-mentioned latter method wherein the air stream through the weft guide channel is formed mainly by virtue of the air jets from the auxiliary nozzles, the air jet from the weft inserting nozzle can reach the vicinities of the second and third auxiliary nozzles, and therefore an interference effect similar to that in the above-mentioned former method occurs. Additionally, in a range where the air stream from the weft inserting nozzle is sufficiently dispersed and the weft yarn carrying action is accomplished only by air jets from the auxiliary nozzles, when the air jet from the preceding auxiliary nozzle reaches the vicinity of the succeeding auxiliary nozzle, the intensity of the air jet from the preceding auxiliary nozzle has been lowered. At this state, when the succeeding auxiliary nozzle ejects an air jet at a high speed, the high speed air jet strikes the air jet (lowered in speed) from the preceding auxiliary nozzle to disturb the air stream in the weft guide channel. Such striking of the air jet from the succeeding auxiliary nozzle air against the air stream in the weft guide channel can not be avoided even by successively ejecting air jets from the auxiliary nozzles sufficiently prior to the air stream reaching the air jet from the succeding auxiliary nozzle.

BRIEF SUMMARY OF THE INVENTION

According to the present invention, in an air jet loom of the type wherein a weft yarn projected from a weft inserting nozzle is carried through a weft guide channel to pick the weft yarn into a shed of warp yarns by air jets ejected from a plurality of auxiliary nozzles, the ejection of the air jets from the auxiliary nozzles is controlled in a manner to simultaneously commence the air jet ejections from all the auxiliary nozzles prior to the time the weft yarn from the weft inserting nozzle reaches the auxiliary nozzle closes to the weft inserting nozzle. With such a manner of operation of the air jet loom, the air jets from the auxiliary nozzles produce a steady state air stream directing to a loom side opposite the weft inserting nozzle, within the weft guide channel, in order to carry the weft yarn through the shed of the warp yarns to effectively accomplish weft picking.

BRIEF DESCRIPTION OF THE DRAWINGS

The features and advantages of the weft picking method and the device for carrying out same in accordance with the present invention will be more clearly appreciated from the following description taken in conjunction with the accompanying drawings in which like reference numerals designate the corresponding parts and elements, and in which.

DETAILED DESCRIPTION OF THE INVENTION

Figure 1:
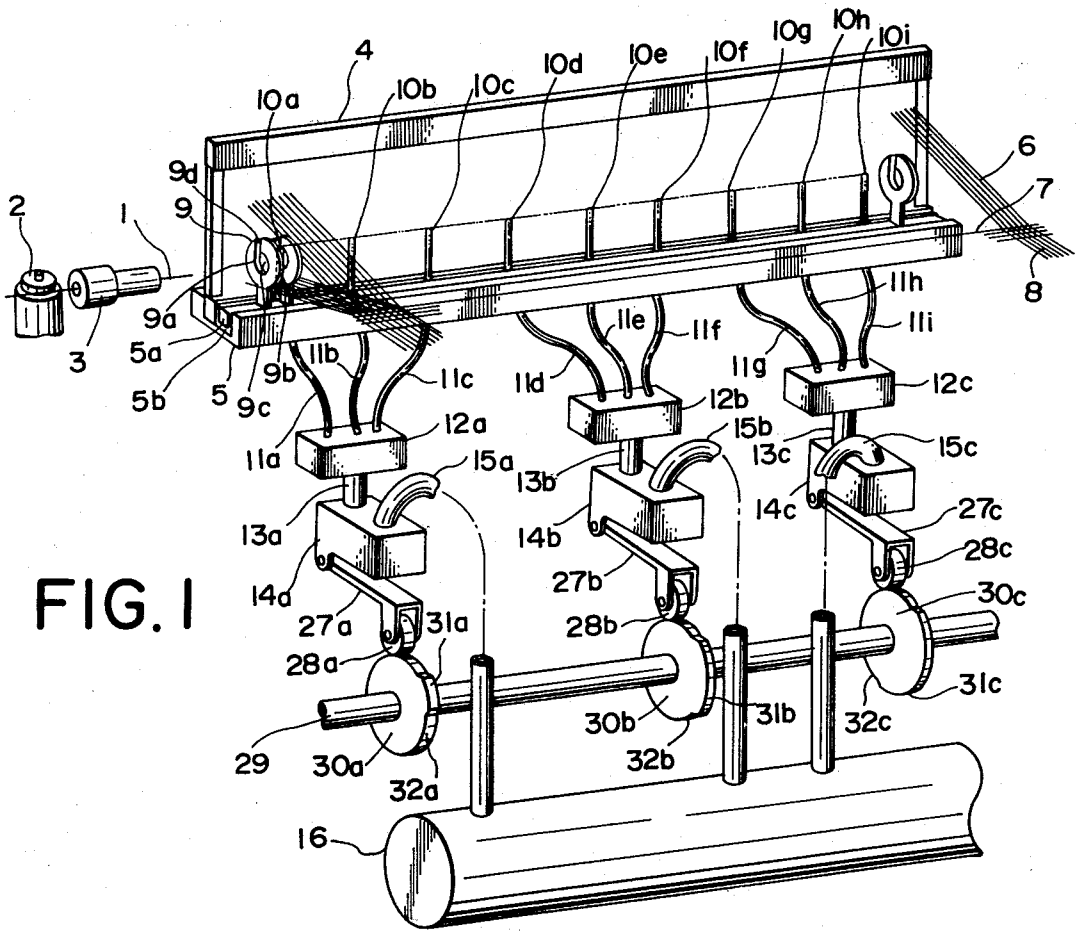
FIG. 1 is a perspective view of a weft picking device of an air jet loom to which the principle of the present invention is applied.

Referring now to FIG. 1 of the drawings, there is shown a weft picking device of an air jet loom to which the present invention is applied. The weft picking device comprises a weft inserting nozzle or main nozzle 3 through which a weft yarn 1 is projected to be picked through a weft guide channel formed by a plurality of air guide members 9. The weft yarn 1 is introduced into the main nozzle 3 after passing a grasping device 2 capable of grasping the weft yarn so that the introduction of the weft yarn to the main nozzle 3 is stopped when necessary. The air guide members 9 are aligned at certain intervals and their bases or foot sections are embedded in a solidified resin or plastic 5*a* so that the air guide members are securely located within the groove of an air guide holder 5*b*. The holder 5*b* is secured to a sley 5 to which a reed 4 is also secured to form a single unit with the air guide members 9. Each air guide member 9 is formed with straight and curved sections 9*a*, 9*b*, which define a generally circular air guide opening 9*c*, and a slit 9*d* communicating with the guide opening in order to allow the weft yarn within the guide opening 9*c* to exit therethrough at a weft yarn beating step by the reed 4. Such an air guide member is referred to as a "closed type air guide member". The air guide openings 9*c* of the successively located air guide members 9 form the above-mentioned weft guide channel. The air guide members 9 are so located that the extension of the axis of the main nozzle 3 passes through the weft guide channel when the reed 4 is positioned at the most backward position. The reference numerals 6, 7, and 8 designate warp yarns, a cloth fell, and a wooven fabric, respectively.

A plurality of auxiliary nozzles 10*a* to 10*i* are aligned parallel with the weft picking direction and at approximately equal intervals. The body of each auxiliary nozzle 13*a* to 13*i* is a metallic pipe having, for example, a diameter of about 7 mm, and its lower section pierces the bottom section of the holder 5*b* fixing it with the resin within the holder. Each auxiliary nozzle 10*a*–10*i* is positioned between the suitable air guide members 9, in which the upper tip section of the auxiliary nozzle body is located in the vicinity of the outer periphery of the weft guide channel defined by the air guide openings 9*c* of the air guide members 9. The upper tip section of the auxiliary nozzle is closed and its outer surface is formed into the smooth and curved shape to easily push the warp yarns aside when each auxiliary nozzle advances between the warp yarns 6.

The upper tip sections of the auxiliary nozzles 13*a* to 13*i* are formed at the cylindrical side walls thereof with nozzle openings, respectively, though not shown. Each nozzle opening of the auxiliary nozzle has a diameter of about 1 mm and is so formed that its axis is not parallel with the axis of the weft guide channel but crosses the air guide channel axis or the main nozzle axis at an angle of about 15 degrees, being directed to the air guide member inner surface defining the air guide opening 9*c*, as viewed from the direction of the axes of the auxiliary nozzles.

The lowermost section of each auxiliary nozzle projects out of the bottom surface of the sley 5. The lowermost sections of the auxiliary nozzles 10*a* to 10*i* connect with flexible pipes 11*a* to 11*i*, respectively, and both the auxiliary nozzle lowermost sections and the flexible pipes are secured to each other, maintaining an air tight seal by using fixing means such as a bands (not shown). Air distributors 12*a* to 12*c* are positioned under the woven fabric 8 and secured to a supporting member (not shown) connected between loom side frames located on both loom sides. Each air distributor is formed with three air discharge holes (not shown). The three discharge holes of the air distributor 12*a* communicate with the first group of auxiliary nozzles 10*a* to 10*c* via the pipes 11*a* to 11*c*, respectively; the three air discharge holes of the air distributor 12*a* communicate with the second group of auxiliary nozzles 10*d* to 10*f* via the pipes 11*d* to 11*f*, respectively; and the three air discharge holes of the air distributor 12*c* communicate with the third group of auxiliary nozzles 10*g* to 10*i* via the pipes 11*g* to 11*i*, respectively. The air discharge holes (not shown) of the air distributor 12*a* to 12*c* communicate via pipes 13*a* to 13*c* with valves 14*a* to 14*c*, respectively, which are secured to the abovementioned supporting member. The air inlets of the valves 14*a* to 14*c* communicate respectively via conduits 15*a* to 15*c* with a large diameter pipe 16 which is closed at one end and connected with a pressurized air source (not shown) such as a compressor. The pipe 16 may be connected with a pressurized air source for the main nozzle 3.

Figure 2:
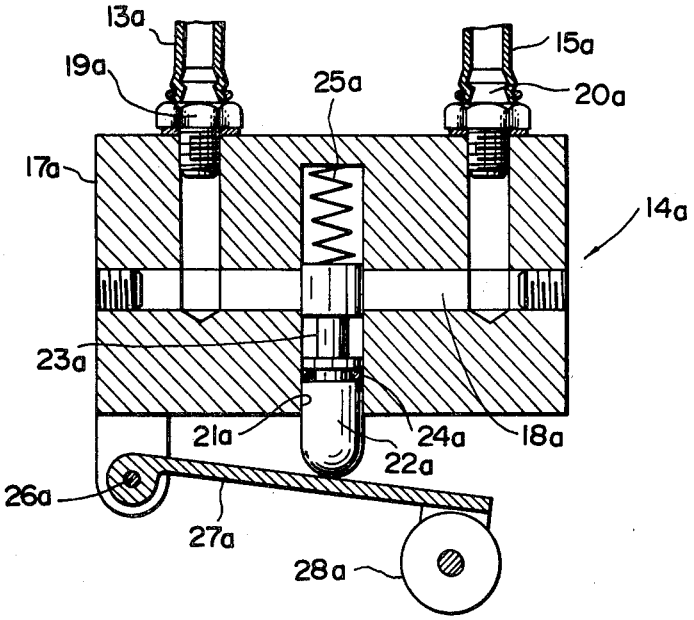
FIG. 2 is a cross-sectional view of a valve used in the loom of FIG. 1, for controlling the supply of high pressure air to the auxiliary nozzles.

The detailed construction of the valve 14*a* is shown in FIG. 2. A body 17*a* of the valve 14*a* is formed with an elongate air flow passage 18*a* which is closed at both ends. A valve bore 21*a* is formed to intersect the mid-section of the air flow passage 18*a* at right angles. Additionally, the pipe 13*a* communicates with the air flow passage 18*a* downstream of the valve bore 21*a* through a connector passage and a fitting 19*a* which is screwed in the valve body 17*a*. The conduit 15*a* communicates with the air flow passage 18*a* upstream of the valve bore 21*a* through a connector passage and another fitting 20*a* which is screwed in the valve body 17*a*. A valve rod member 22*a* is slidably disposed within the valve bore 21*a* and formed with a reduced diameter section 23*a* which is smaller than the air flow passage 18*a*.

When the reduced diameter section 23*a* aligns with the air flow passage 18*a*, the conduit 15*a* communicates with the pipe 13*a* to supply the pressurized air from the conduit 15*a* to the pipe 13*a*. An O-ring 24*a* is disposed within a peripheral groove of the valve rod member 22*a*. The valve rod member 22*a* is biased downward in the drawing or in the direction to project out of the valve bore 21*a* under the action of a return spring 25*a* disposed in the valve bore 21*a*. As shown, the lower end of the valve rod member 22*a* is biased to contact the mid-section of a swingable arm 27*a* whose one end is rotatably mounted on a pin 26*a* secured to the valve body 17*a*, so that the swingable arm 27*a* is swingable relative to the valve body 17*a*. A cam follower 28*a* is rotatably attached at the other or free end of the swingable arm 27*a*. It will be understood that the detailed constructions of the valves 14*b* and 14*c* are the same as that of the valve 14*a* and therefore omitted for the purpose of simplicity of illustration. Hence, the valves 14*b* and 14*c* are provided with a swingable arm 27*b* with a cam follower 28*b* and a swingable arm 27*c* with a cam follower 28*c*, respectively.

The cam followers 28*a* to 28*c* are biased to contact the surfaces of cams 30*a* to 30*c* which are fixedly mounted on a shaft 29 which is rotatable in time relation with the operational cycle of the loom. The shaft 29 is rotatably supported by the above-mentioned loom side frames. The cams 30*a* to 30*c* are formed with high lobe sections 31*a* to 31*c* and low lobe sections 32*a* to 32*c*, respectively. The high lobe sections 31*a* to 31*c* of the cams 30*a* to 30*c* are so constructed and arranged to start to contact the cam followers 28*a* to 28*c*, respectively, at the same timings in the loom operational cycle, and to separate from the cam followers 28*a* to 28*c* in the order of 31, 31*b* and 31*c*. In other words, the peripheral lengths of cam high lobe sections 31*a* to 31*c* are larger in the order to 31*c*, 31*b* and 31*a*. With this, for example, when the cam follower 28*a* of the valve 14*a* contacts the surface of the low lobe section 32*a* of the cam 30*a*, the swingable arm 27*a* rotates clockwise in the drawing to allow the valve rod member 22*a* to descend. Then, a large diameter section of the valve rod member closes the air flow passage 18*a* to block communication between the conduit 15*a* and the pipe 13*a*. When the cam follower 28*a* contacts the surface of the high lobe section 31*a*, the swingable arm 27*a* rotates counterclockwise to cause the valve rod member 22*a* to ascend in the drawing. Then, the small diameter section 23*a* of the valve rod member 22*a* is located in the air flow passage 18*a* to establish communication between the conduit 15*a* and the pipe 13*a*.

Figure 3:
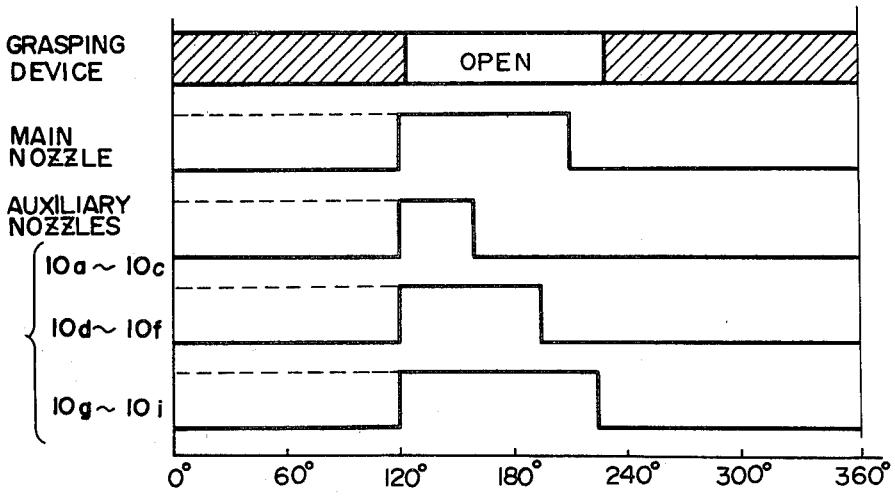
FIG. 3 is a timing chart showing the timings for operating the weft picking device of the loom of FIG. 1.

The manner of operation of the weft picking device shown in FIG. 1 will be explained with reference to FIG. 3.

Until the operational cycle of the loom reaches about 120 degrees after the beating up operation of an already picked weft yarn with reed 4, the cam followers 28*a* to 28*c* of the valves 14*a* to 14*c* remain contacted with the surfaces of the low lobe sections 32*a* to 32*c* of the cams 30*a* to 30*c*, respectively, so that all the valves 14*a* to 14*c* remain closed. When the loom operational cycle reaches about 120 degrees, the cam followers 28*a* to 28*c* all contact the surfaces of the high lobe sections 31*a* to 31*c*, respectively, and consequently all the valves 14*a* to 14*c* open. As a result, the high pressure air is supplied to all the auxiliary nozzles 10*a* to 10*i* via the large diameter pipe 16, the conduits 15*a* to 15*c*, the valves 14*a* to 14*c*, the pipes 13*a* to 13*c*, and the distributors 12*a* to 12*c*. Additionally, almost at the same time, an air jet is ejected from the main nozzle to blow forward the leading end section of the weft yarn to be picked, straightly extending the weft yarn leading end. Then, a steady state air flow directed toward the loom side opposite the weft inserting nozzle 3 is produced.

When the loom operational cycle reaches about 125 degrees, the grasping device 2 releases the weft yarn to be picked so that the weft yarn 1 is pulled by the air jet from the weft inserting nozzle 3 to be projected into the air guide channel. Immediately after this, the thus projected weft yarn is carried through the weft guide channel by the air jets from the auxiliary nozzles 10*a* to 10*i*.

When the loom operational cycle reaches about 160 degrees, the leading end of the weft yarn 1 passes by the first group of auxiliary nozzles 10 to 10*c* and reaches the vicinity of the second group of auxiliary nozzles 10*d* to 10*f*. At this time, the cam follower 28*a* of the valve 14*a* starts to contact the low lobe section 32*a* of the cam 30*a* to close the valve 14*a*, and therefore the air jet ejections from the first group of auxiliary nozzles 10*a* to 10*c* are stopped.

When the loom operational cycle reaches about 200 degrees, the leading end of the weft yarn 1 passes by the second group of auxiliary nozzles 10*d* to 10*f* and reaches the vicinity of the third group of auxiliary nozzles 10*g* to 10*i*. At this time, the cam follower 28*b* of the valve 14*b* starts to contact the low lobe section 32*b* of the cam 30*d* to close the valve 14*b*, and therefore the air jet ejections from the second group of auxiliary nozzles 10*d* to 10*f* are stopped.

When the loom operational cycle reaches about 210 degrees, the air jet ejection from the weft inserting nozzle 3 is stopped. Upon this, the weft picking further continues by virtue of the inertia of the carried weft yarn and of the pulling force of the air jets from the third group of auxiliary nozzles 10*g* to 10*i*. At the loom operational cycle of about 230 degrees, the leading end section of the weft yarn 1 passes by the third group of auxiliary nozzles 10*g* to 10*i* to complete the weft picking. Accordingly, simultaneously with the closing operation of the grasping device 2 to stop the movement of the weft yarn 1, the cam follower 28*c* starts to contact the low lobe section 32*c* of the cam 30*c* to close the valve 14*c* in order to stop the air jet ejections from the third group of auxiliary nozzles 10*g* to 10*i*.

While the auxiliary nozzles 10*a* to 10*i* have been shown and described as being divided into three groups in which the auxiliary nozzles of the same group respective operate in the same manner, it will be understood that the auxiliary nozzles may be operated independently from each other.

As will be appreciated from the above, according to the present invention, the ejection of air jets from the auxiliary nozzles is controlled in a manner to simultaneously commence the air jet ejections from all the auxiliary nozzles prior to the time the weft yarn reaches the auxiliary nozzle closest to the weft inserting nozzle. Accordingly, even though, at the initial stage of the weft picking, a turbulence of air stream may temporarily be produced in the weft guide channel for the reasons that the air jets from the auxiliary nozzles strike still air in the weft guide channel and the air jets from the auxiliary nozzles interfere with each other, such a temporary turbulence flow is abruptly cancelled and a steady state air stream directed to the loom side opposite the weft inserting nozzle can be effectively produced within the weft guide channel. This steady state air stream stably carries the weft yarn through the weft guide channel, and additionally allows the air flow due to the air jet from the weft inserting nozzle to advance to a required location in the weft guide channel. Furthermore, the weft picking is carried out without slackening the weft yarn by successively stopping the air jets from the auxiliary nozzles in the order of the weft yarn passing by the respective auxiliary nozzles.

What is claimed is:

1. A method of weft picking in an air jet loom of the type wherein a weft yarn projected by an air jet from a weft inserting nozzle is carried through a weft guide channel to pick the weft yarn into the shed of warp yarns by air jets from a plurality of auxiliary nozzles, said method comprising the steps of:

controlling the ejection of air jets from said auxiliary nozzles in a manner to simultaneously commence the air jet ejections from all said auxiliary nozzles prior to the time the weft yarn from said weft inserting nozzle reaches the auxiliary nozzle closest to said weft inserting nozzle, maintaining the air jet ejections from all said auxiliary nozzles for a selected time interval, and thereafter successively stopping the air jet ejections from the respective auxiliary nozzles in the order of the weft yarn passing by said auxiliary nozzles.

2. A method of weft picking in an air jet loom, comprising the steps of:

projecting a weft yarn from a weft inserting nozzle under the influence of an air jet ejected from said weft inserting nozzle;

carrying said weft yarn from said weft inserting nozzle through a weft guide channel to pick the weft yarn into the shed of warp yarns by ejecting air jets from a plurality of auxiliary nozzles; and controlling the ejection of air jets from said auxiliary nozzles in a manner (1) to simultaneously commence the air jet ejections from all said auxiliary nozzles prior to the time the weft yarn from said weft inserting nozzle reaches the auxiliary nozzle closest to said weft inserting nozzle, (2) maintaining the air jet ejections from all said auxiliary nozzles for a predetermined time interval, and (3) thereafter successively stopping the air jet ejections from the respective auxiliary nozzles in the order of the weft yarn passing by said auxiliary nozzles.

3. A method as claimed in claim 2, wherein said plurality of auxiliary nozzles is divided into a plurality of groups, wherein the air jet ejection controlling steps include the step of controlling the air jet ejections from the same group of auxiliary nozzles simultaneously in a manner to commence and stop the air jet ejections from the same group of auxiliary nozzles.

4. A method as claimed in claim 3, wherein said plurality of groups of auxiliary nozzles includes first, second, and third groups which are closer to said weft inserting nozzle in the order named, and wherein the air jet ejection controlling step includes the steps, in the following order, of:

simultaneously commencing the air jet ejections from all of said auxiliary nozzles, and stopping air jet ejections from said first, second, and third groups of auxiliary nozzles in the order named.

5. A method of weft picking in an air jet loom equipped with a weft inserting nozzle, and first, second, and third groups of auxiliary nozzles which are closer to said weft inserting nozzle in the order named, and a plurality of closed type air guide members to define a weft guide channel, and a weft yarn grasping device, said method comprising the steps, in the following order, of simultaneously commencing the air jet ejections from said weft inserting nozzle and all of said auxiliary nozzles, maintaining the air ejections from all of said auxiliary nozzles operating said grasping device to release the weft yarn to allow it to move, stopping the air jet ejections from said first group of auxiliary nozzles, stopping the air jet ejections from the second group of auxiliary nozzles, stopping the air jet ejections from said weft inserting nozzle, stopping the air jet ejections from said third group of auxiliary nozzles, simultaneously with operating said grasping device to catch the weft yarn to stop the movement thereof.

6. A weft picking device of an air jet loom, comprising:

a weft inserting nozzle for projecting a weft yarn under the influence of an air jet ejected therefrom;

air guide means defining a weft guide channel through which the weft yarn from said weft yarn inserting nozzle is picked into the shed of warp yarns;

a plurality of auxiliary nozzles for ejecting air jets to carry the weft yarn from said weft inserting nozzle through the weft guide channel; and means for controlling the ejection of air jets from said auxiliary nozzles in a manner (1) to simultaneously commence the air jet ejections from all of said auxiliary nozzles prior to the time the weft yarn from said weft inserting nozzle reaches the auxiliary nozzle closest to said weft inserting nozzle, (2) to maintain the air jet ejections from all said auxiliary nozzles for a selected time interval, and (3) thereafter successively stopping the air jet ejections from the respective auxiliary nozzles in the order of the weft yarn passing by said auxiliary nozzles.

7. A weft picking device as claimed in claim 6, wherein said plurality of auxiliary nozzles is divided into a plurality of groups, and wherein said air jet ejection controlling means includes means for controlling the air jet ejection from the same group of auxiliary nozzles simultaneously in a manner to commence and stop the air jet ejections from the same group of auxiliary nozzles.

8. A weft picking device as claimed in claim 7, wherein said plurality of groups of auxiliary nozzles includes first, second, and third groups which are closer to said weft inserting nozzles in the order named.

9. A weft picking device as claimed in claim 8, wherein said air jet ejection controlling means includes means for controlling air jet ejections from said plurality of groups of auxiliary nozzles in a manner to firstly simultaneously commence the air jet ejections from all of said auxiliary nozzles, and thereafter stop the air jet ejections from said first, second, and third groups of auxiliary nozzles in the order named.

10. A weft picking device as claimed in claim 8, further comprising weft yarn grasping means for catching and releasing the moving weft yarn prior to the introduction of the weft yarn into said weft guide channel, in accordance with the operational cycle of the loom.

11. A weft picking device as claimed in claim 10, wherein said air jets ejection controlling means includes means for controlling the operations of said weft inserting nozzle, said auxiliary nozzles, and said grasping means in a manner to firstly simultaneously commence air jet ejections from said weft inserting nozzle and all of said auxiliary nozzles, secondly operate said grasping means to release the weft yarn to allow it to move, thirdly stop the air jet ejections from said first group of auxiliary nozzles, fourthly stop the air jet ejections from said second group of auxiliary nozzles, fifthly stop the air jet ejection from said weft inserting nozzle, and lastly stop the air jet ejection from said third group of auxiliary nozzles simultaneously with operating said grasping means to catch the weft yarn to stop the movement thereof.

12. A weft picking device as claimed in claim 6, wherein said air guide means includes a plurality of air guide members each of which is formed with an almost closed annular section defining therein an air guide opening, said air guide member annular section having a slit communicating with said air guide opening through which slit the weft yarn is capable of exiting the air guide opening in accordance with the loom operational cycle, said weft guide channel being formed by successive air guide openings of said air guide members.

* * * * *